US005678114A

United States Patent [19]

Eko et al.

[11] Patent Number: 5,678,114

[45] Date of Patent: Oct. 14, 1997

[54] AUTOMATIC PHOTOGRAPHIC DEVELOPING APPARATUS FOR PHOTOSENSITIVE MATERIALS

[75] Inventors: Hidemitsu Eko, Wakayama; Haruo Hakamada; Hideo Ishii, both of Hino, all of Japan

[73] Assignee: Noritsu Koki Co., Ltd., Wakayama, Japan

[21] Appl. No.: 489,029

[22] Filed: Jun. 9, 1995

[30] Foreign Application Priority Data

Jun. 14, 1994 [JP] Japan ..... 6-155193

[51] Int. Cl.[6] ..... G03D 3/02

[52] U.S. Cl. ..... 396/578; 396/626; 396/630; 73/290 R; 73/304 R; 340/620

[58] Field of Search ..... 354/298, 322, 354/323, 324; 340/620–624, 585; 73/292, 304 R, 290 R, 305–311; 367/162, 908, 157; 396/578, 622, 624, 626, 630

[56] References Cited

U.S. PATENT DOCUMENTS

| | | | |
|---|---|---|---|
| 4,716,762 | 1/1988 | Eynard | 73/295 |
| 4,771,272 | 9/1988 | Barnes | 340/624 |
| 4,958,518 | 9/1990 | Duenstl et al. | 73/290 V |
| 4,964,090 | 10/1990 | McCarthy | 367/162 |
| 5,056,363 | 10/1991 | Arekapudi et al. | 73/292 |
| 5,230,563 | 7/1993 | Shalvi | 340/620 |
| 5,460,926 | 10/1995 | Komatsu et al. | 396/626 |

*Primary Examiner*—D. Rutledge

*Attorney, Agent, or Firm*—Frishauf, Holtz, Goodman, Langer & Chick

[57] ABSTRACT

An automatic photographic developing apparatus for photosensitive materials includes a number of processing baths which are filled with processing solutions of different types for processing silver halide coated photosensitive materials. A same number of solution tanks communicated with the respective processing baths are provided for supplying the processing solutions, produced by dissolving solid agents, to the respective processing baths. A level sensor is installed in each of the solution tanks which monitors the level of the processing solution in the respective solution tanks. A plurality of shield members are provided, each shield member surrounding and protecting a respective one of the level sensors, and each shield member being detachably mounted to its respective level sensor. Each of the shield members includes a plurality of split members which are separable from each other and which are connectable to each other to surround the respective level sensor.

5 Claims, 10 Drawing Sheets

AUTOMATIC PHOTOGRAPHIC DEVELOPING APPARATUS FOR PHOTOSENSITIVE MATERIALS

FIELD OF THE INVENTION

The present invention relates to an automatic photographic developing apparatus for photosensitive materials which is reduced in the overall size, improved in the operability, increased in the stabilization of chemicals, and eased in the feeding and maintenance.

After silver halide coated photosensitive materials (referred to as photosensitive materials or photographic materials hereinafter) are exposed, they are subjected to a series of development, removal of residual silver, washing, and stabilization processes. Black-and-white or color developer agents are used for the development, bleaching and fixing agents for the removal of residual silver, local running water or ion exchange water for the rinsing, and stabilizer agents for the stabilization. Such agents are called as processing solutions for conducting a series of the processes.

In general, the processes are implemented by passing a photosensitive material through a row of processing baths arranged in the foregoing automatic photographic developing apparatus for photosensitive materials (referred to as an automatic developing apparatus hereinafter). It is known that the automatic photographic developing apparatus of a common type comprises a developing station, a residual silver bleaching station, a rinsing or stabilizing station, and a drying station through which photosensitive materials are transferred for their respective processes.

In the common automatic photographic developing apparatus, the processing solutions are replenished time to time to maintain a constant degree of their activation in the processing baths. More particularly, replenishments of the processing solutions are supplied from their respective storage tanks to the processing baths during the processing action. In common, the processing solutions stored in their respective storage tanks are prepared in separate locations before loaded into the same. This is done by a traditional manual labor as is described below.

Processing agents for the silver halide coated photosensitive materials (referred to as photographic processing agents hereinafter) are commercially available in powder or liquid form. Each powder agent is dissolved by manual labor in a given amount of water forming a processing solution. Also, a liquid agent is diluted with a given amount of water. As the storage tanks are disposed close to their respective processing baths, they require a considerable extension of installation space. A most popular model of the automatic photographic developing apparatus used in a so-called mini-laboratory shop has such storage tanks of a built-in type. The built-in tanks will allow the overall size of the automatic photographic developing apparatus to be hardly minimized.

When the processing baths filled with their respective solutions for processing the silver halide coated photosensitive materials are communicated with solution tank into which solid agents are directly loaded for dissolution, the automatic photographic developing apparatus may be decreased in the overall size. In addition, the dissolution of solids by manual labor will be eliminated. The apparatus is thus capable of producing prints of uniform quality. Furthermore, storage containers which are commonly made of polymer for storage of particularly the liquid agents are not needed or for the solid agents will be reduced in the number, contributing to the environment friendly aspect of the apparatus.

For feeding the solid agent into the solution tank, it is a good idea to use a chute or guide along which the solid agent drops spontaneously into the solution. However, as the solution tank is periodically checked for routine maintenance, e.g. replacement of filters after a given length of service, the guide disposed in the solution tank may disturb the maintenance action. The guide should thus be constructed of detachable type.

It is noted that carelessness may cause the detachable guide to be lost when having been detached. Otherwise, the machine may be restarted without the guide being returned back to its original location.

For avoiding the absence of the guide in operation, a sensor is provided for examining whether or not the guide is correctly set in its location. The mounting of the sensor makes the solution tank less simple in construction and will thus increase the overall cost.

It is also known that the solution tank includes a level sensor for monitoring the level of the solution and upon detecting its lowest, commanding replenishing of the solution. The level sensor may be malfunctioned, destroyed, or decreased in the life period if it is hit by pieces of the solid agent falling into the solution.

For preventing any direct contact with the dropping solid agent, an improvement shown in FIG. 9 has been proposed in which a level sensor 103 is protected with a cover 102 mounted to a solution tank 101 communicated to a processing bath 100. The cover 102 may be accompanied with a shield plate 104. As shown in FIG. 10, the shield plate 104 may be mounted directly to the wall of the solution tank 101. As the shield plate 104 protecting the level sensor 103 is tightened to the cover 102 or solution tank 101, it may limit the location of the level sensor 103.

Also, the tightening of the shield plate 104 to the cover 102 or solution tank 101 is implemented by using screws, Welding, or bonding, thus adding an extra step and lowering the efficiency of assembly.

The guide is used for loading the solid agent into the solution tank. If the guide is short and allows the solid agent to jump from its end into the solution, drops of the solution are splashed on and pieces of the solid agents may strike against the level sensor and a heater provided for control of the solution temperature. However, when the guide is extended to direct the solid agent into the processing solution in the solution tank, its installation creates another drawback. As the guide is disposed in the solution tank to direct the solid agent into the solution, it has to be detachable for ease of cleaning and maintenance of the solution tank and will hardly contribute to the simple construction of the solution tank.

It is an object of the present invention, in view of the above aspects, to provide an automatic photographic developing apparatus for photosensitive materials designed for eliminating the drawbacks produced in loading solid processing agents into solution tanks. More specifically, an object of the present invention is to ease the maintenance of the solution tanks and to prevent the guide from being lost with carelessness and from being absent during the operation. Further objects of the present invention are to allow a higher degree of freedom for installation of the level sensor and to increase the efficiency of the maintenance of the level sensor. A still further object of the present invention is to allow the guide extension to be mounted and dismounted with much ease because of the use of a filter.

SUMMARY OF THE INVENTION

For achievement of the foregoing objects of the present invention, a first automatic photographic developing apparatus for photosensitive materials includes a number of processing baths which are filled with processing solutions of different types for processing silver halide coated photosensitive materials and the same number of solution tanks communicated with their respective processing baths for supplying the processing solutions produced by dissolution of solid agents, wherein each of the solution tanks is protected with an openable cover and accompanied with a guide along which a solid agent is loaded into the solution tank for dissolution as runs down by its own weight, the guide being pivotably mounted for movement between a guiding position and a non-guiding position so that the guide can hold the openable cover open when it is in the non-guiding position.

A second another automatic photographic developing apparatus for photosensitive materials according to the present invention includes a number of processing baths which are filled with processing solutions of different types for processing silver halide coated photosensitive materials and the same number of solution tanks communicated with their respective processing baths for supplying the processing solutions produced by dissolving solid agents, wherein each of the solution tanks has a level sensor installed therein which monitors the level of the processing solution and is surrounded by and protected with a shield member.

According to a third automatic photographic developing apparatus for photosensitive materials the shield member may detachably be mounted to the level sensor.

A fourth automatic photographic developing apparatus for photosensitive materials according to the present invention includes number of processing baths which are filled with processing solutions of different types for processing silver halide coated photosensitive materials and the same number of solution tanks communicated with their respective processing baths for supplying the processing solutions produced by dissolution of solid agents, wherein each of the solution tanks has a filter detachably installed therein and is accompanied with a extension which is mounted on the filter for directing a solid agent into the processing solution of the solution tank.

A fifth automatic photographic developing apparatus for photosensitive materials according to the present invention includes a number of processing baths which are filled with processing solutions of different types for processing silver halide coated photosensitive materials and the same number of solution tanks communicated with their respective processing baths for supplying the processing solutions produced by dissolution of solid agents, wherein each of the solution tanks is protected with an openable cover and accompanied with a guide along which a solid agent is loaded into the solution tank for dissolution as runs down by its own weight, the guide being pivotably mounted for movement between a guiding position and a non-guiding position and urged by a return spring so that it can automatically return to the guiding position.

In the first apparatus defined above the solid agent is guided by the guide and runs down by its own weight into the solution tank. For carrying out a maintenance action in the solution tank, the cover is opened and the guide is kept in its non-guiding position so as to ease the maintenance action in the solution tank. After the maintenance action is completed, the guide is returned to the original guiding position. If the guide fails to be returned back to the guiding position and stays in the non-guiding position, it allows the cover not to be closed resulting in generation of a warning signal. Accordingly, the apparatus will be prevented from running with the guide set in the non-guiding position.

In the second apparatus defined above the level sensor in the solution tank is protected with the shield member so that no piece of the solid agent is allowed to strike against the level sensor. Accordingly, the positioning of the level sensor in the solution tank will have a higher degree of freedom.

In the third apparatus defined above the shield member is detachably mounted to the level sensor which can thus be handled With much ease during the maintenance action.

In the fourth apparatus defined above, the guide extension is mounted on the filter for directing the solid agent into the processing solution in the solution tank thus allowing no straight drop of the solid agent into the solution. Accordingly, unwanted splashing of the processing solution will be prevented and undesired physical contact of the solid agent with the level sensor, the heater, or other components in the solution tank will be avoided. As the guide extension is directly mounted on the filter, it requires no specific mounting jigs for installation. The guide extension and filter are detachable and will easily be removed from the solution tank for ease of maintenance.

In the fifth apparatus defined above the guide is adapted for allowing the solid agent to be guided with and runs down by its own weight into the solution tank for loading. For starting a maintenance action in the solution tank, the cover is opened and the guide is turned to its non-guiding position as resisting against the urging force of the return leaf spring. As the guide being held down by the cover, it is kept away from the guiding position and thus allows the solution tank to be clearly accessed for ease of the maintenance. After the maintenance is completed, the guide extension is released and automatically returned from the non-guiding position to the original guiding position by the urging action of the return leaf spring. Accordingly, the apparatus will be prevented from running with the guide extension being set in its non-guiding position.

DETAILED DESCRIPTION OF THE PREFERRED EMBODIMENT

Figure 1:
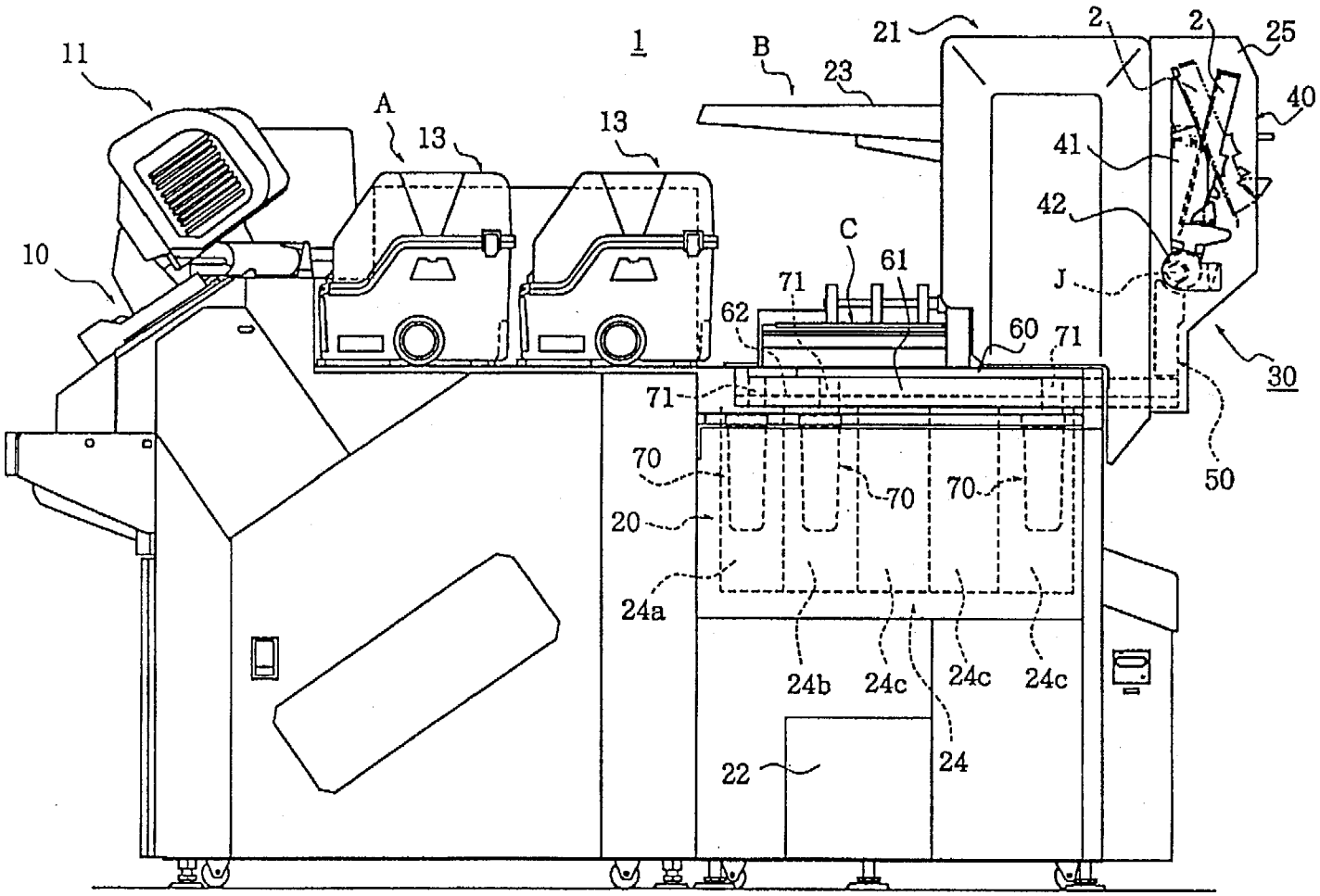
FIG. 1 is a front view of a photosensitive material processing apparatus according to the present invention.
Figure 2:
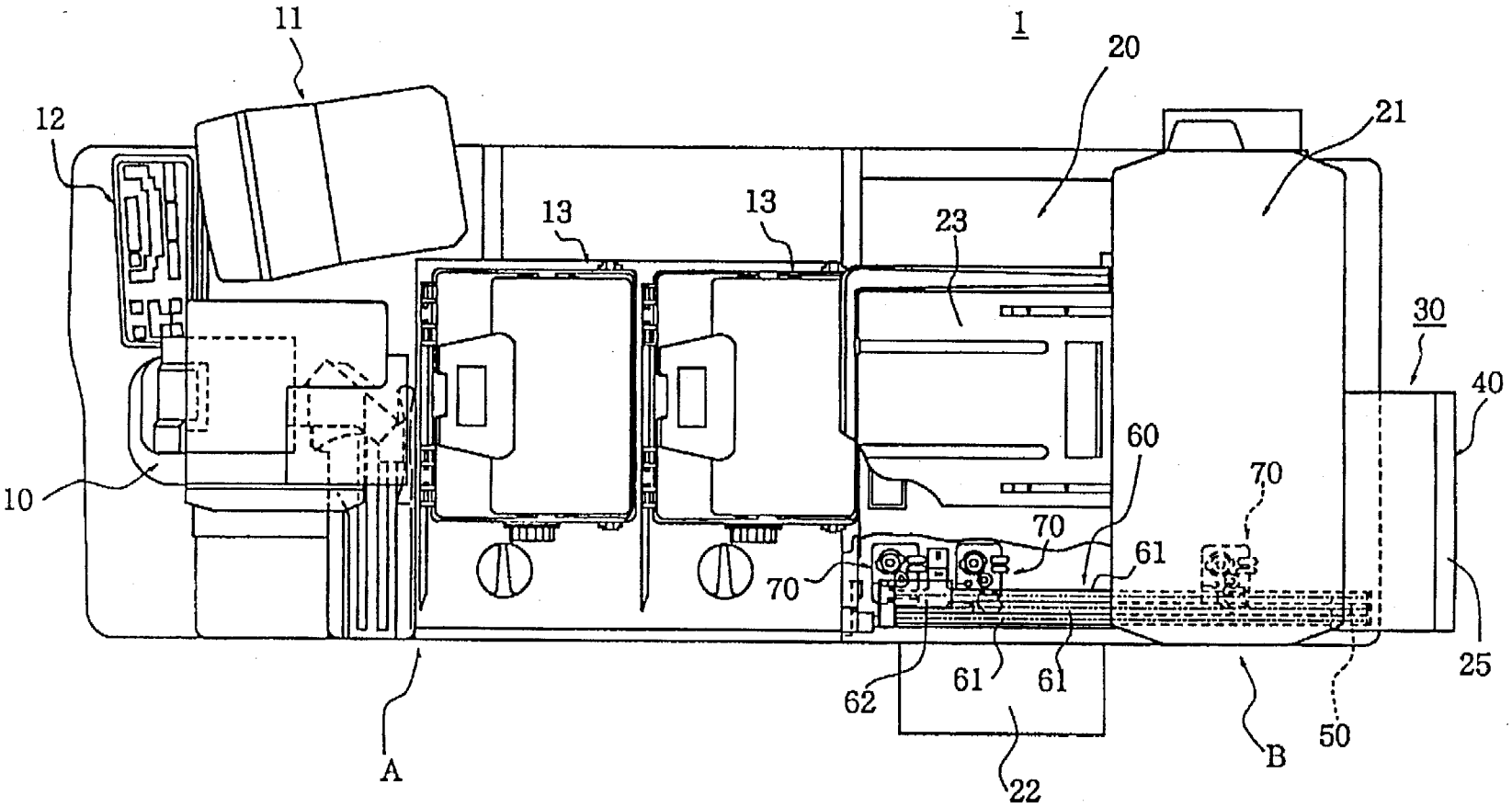
FIG. 2 is a plan view of the photosensitive material processing apparatus.
Figure 3:
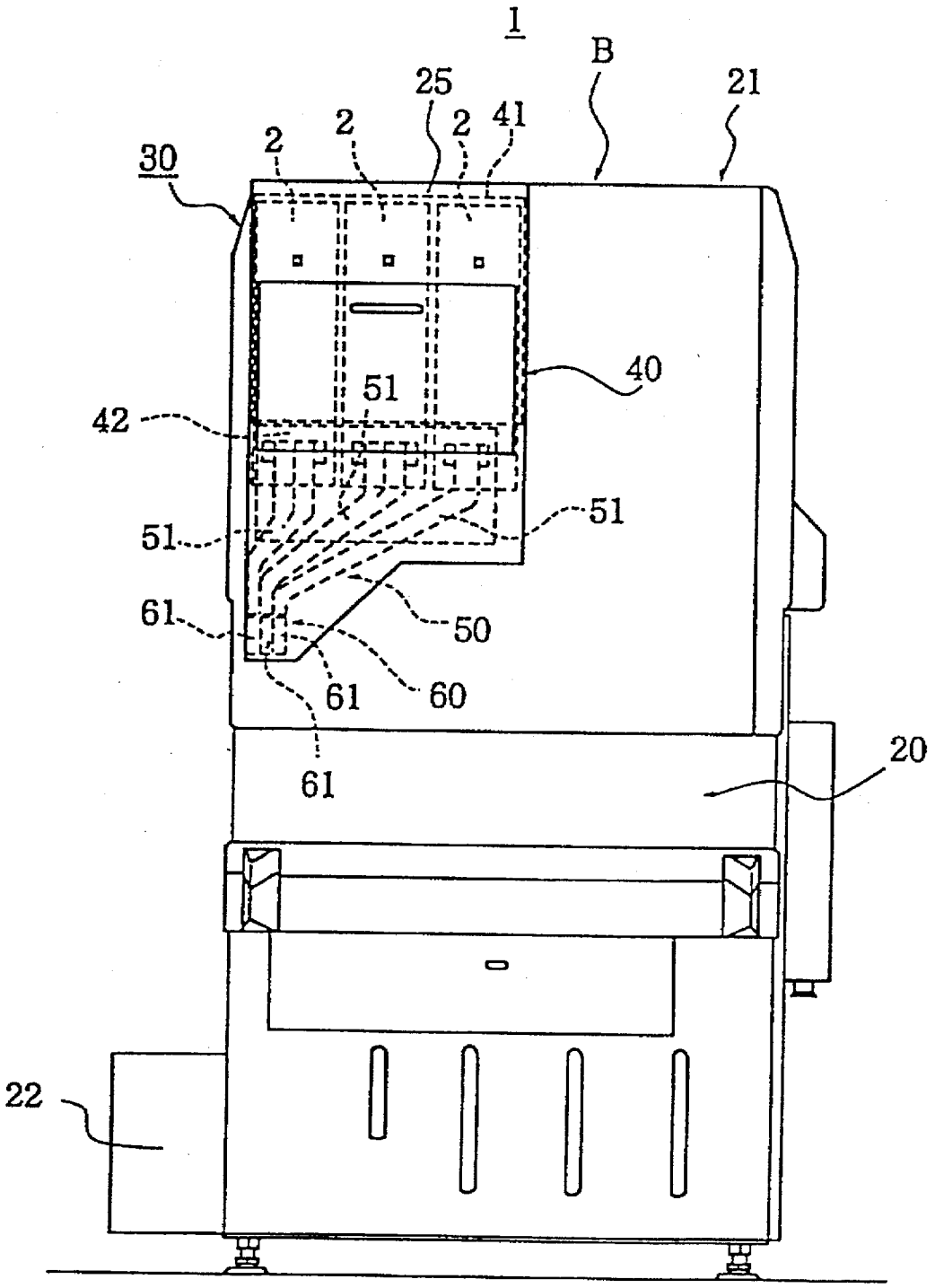
FIG. 3 is a right side view of the photosensitive material processing apparatus.
Figure 4:
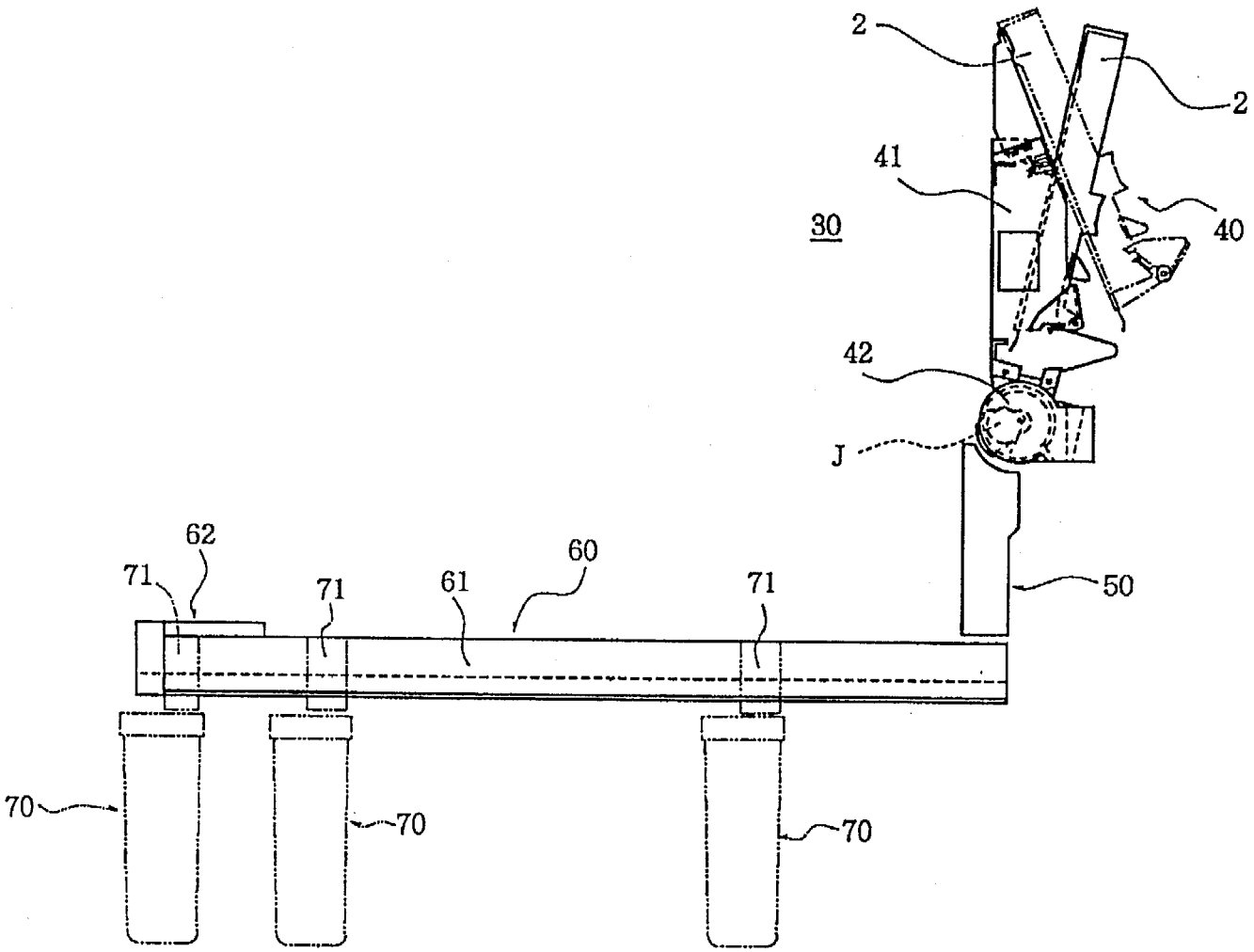
FIG. 4 is a diagram showing a route of transferring solid agents in the apparatus.

The present invention will be described in the form of a photosensitive material processing machine referring to the accompanying drawings. FIG. 1 is a front view of the photosensitive material processing machine, FIG. 2 is a plan view of the same, and FIG. 3 is a right side view of the same. FIG. 4 illustrates a route for transferring a solid processing agent.

The photosensitive material processing machine 1 comprises a photographic printer apparatus A and an automatic developing apparatus B which are coupled to each other integrally. The photographic printer apparatus A includes a printing unit 10, a display unit 11, and an operating unit 12. Magazine containers 13 which contain rolls of printing paper or undeveloped silver halide coated material are loaded to the top of the photographic printer apparatus A. The printing paper released from the magazine container 13 is exposed to an original image of light at the printing unit 10 of the photographic printer apparatus A and then transferred to the automatic developing apparatus B.

The automatic developing apparatus B includes a processor unit 20, a dryer unit 21, and a controller unit 22. The exposed paper is developed in the processor unit 20 and dried in the dryer unit 21, forming photographic prints. The prints are transferred by a transfer conveyor C to a receiver of a tailor-made sorter not shown or to an output platform 23. The processor unit 20 has a processing tub 24 which comprises a color developing bath 24*a*, a bleaching fixing bath 24*b*, and three stabilizing baths 24*c*. The prints are thus color developed, bleached, fixed, and stabilized as they are transferred. The automatic developing apparatus B in the embodiment is comprised of but not limited to substantially three major baths for color development, bleaching and fixing, and stabilization. It may include four separate tubs for color development, bleaching, fixing, and stabilization with equal success.

The automatic developing apparatus B is also provided with a processing agent replenisher 30 for replenishing solid processing agents J of different types into the color developing bath 24*a*, breaching and fixing bath 24*b* and stabilizing baths 24*c* of the processing tub 24 respectively. The processing agent replenisher 30 comprises a solid agent feeder section 40, a solid agent dispatcher section 50, a solid agent conveyer section 60, and solution tanks 70.

The solid agent feeder section 40 and the solid agent dispatcher section 50 are disposed in a casing 25 which is mounted to a side wall of the dryer unit 21. The solid agent feeder 40 includes a loader 41 and a feeder 42. Solid agent cartridges 2 containing the solid agents J of different types to be distributed to their respective solution baths of the processing tub 24 are loaded to the loader 41. The solid agents J are supplied from their respective solid agent cartridges 2 by the action of the feeder 42.

The solid agent dispatcher section 50 has dispatching chutes 51 arranged for communication to their respective solution baths of the processing tub 24. The dispatching chutes 51 extend from the feeder 42 of the solid agent feeder section 40 and conveying passages 61 of the solid agent conveyor section 60. The solid agents J supplied by the feeder 42 of the solid agent feeder section 40 fall and run along the dispatching chutes 51 to their respective conveying passages 61 of the solid agent conveyor section 60.

The solid agent conveyer section 60 includes a conveyor means 62 for conveying the solid agents J along the conveying passages 61 up to guides 71 of the solution tanks 70 arranged to communicate with their respective solution baths of the processing tub 24 in the processor unit 20.

Figure 5:
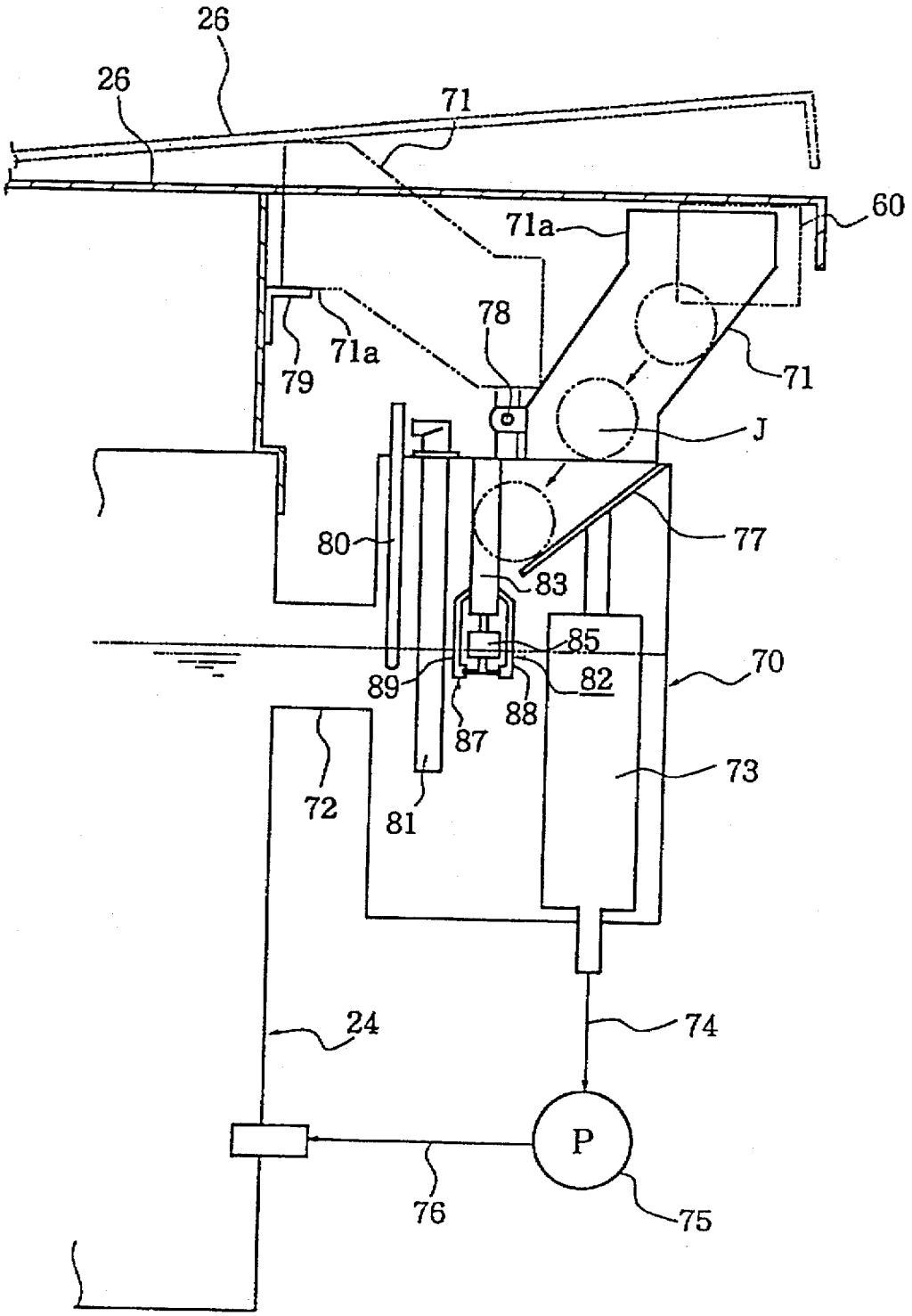
FIG. 5 is a cross sectional view of a solution tank disposed in a processing tub of the apparatus.
Figure 6:
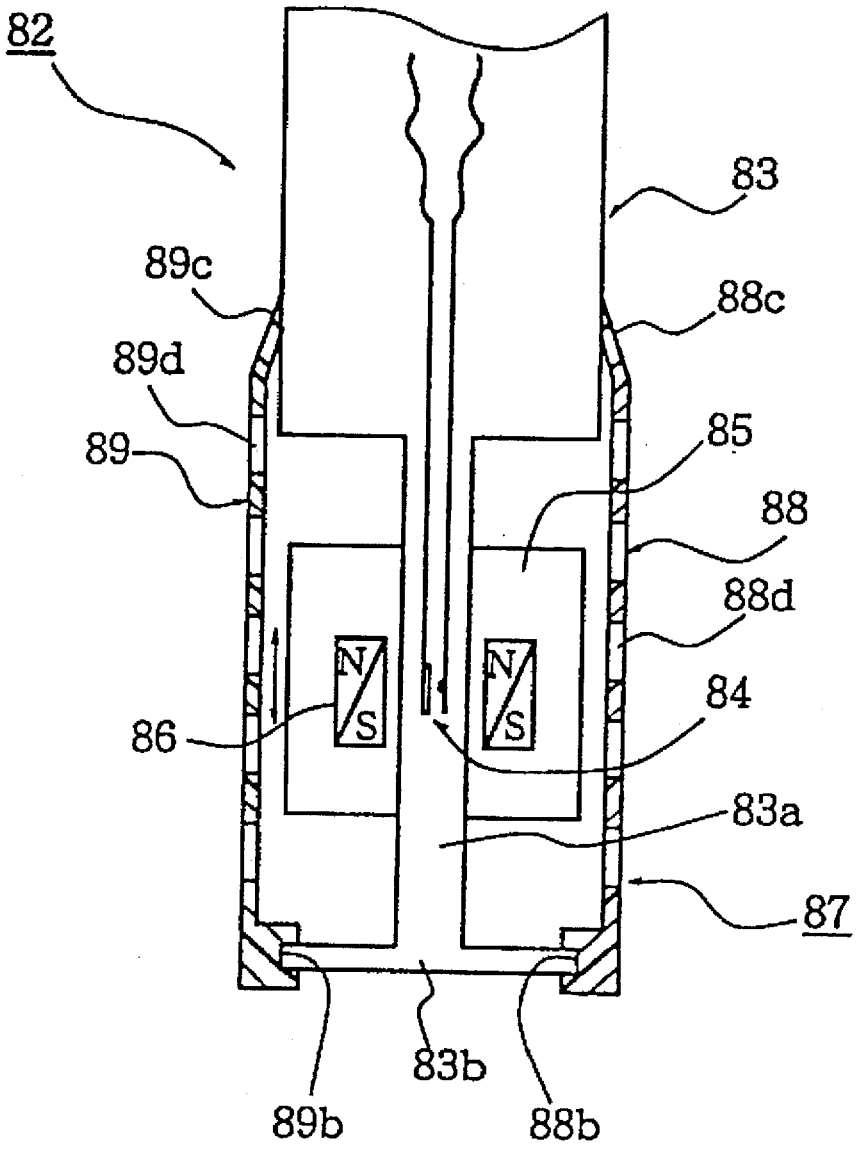
FIG. 6 is an enlarged cross sectional view of a level sensor in the solution tank.
Figure 7:
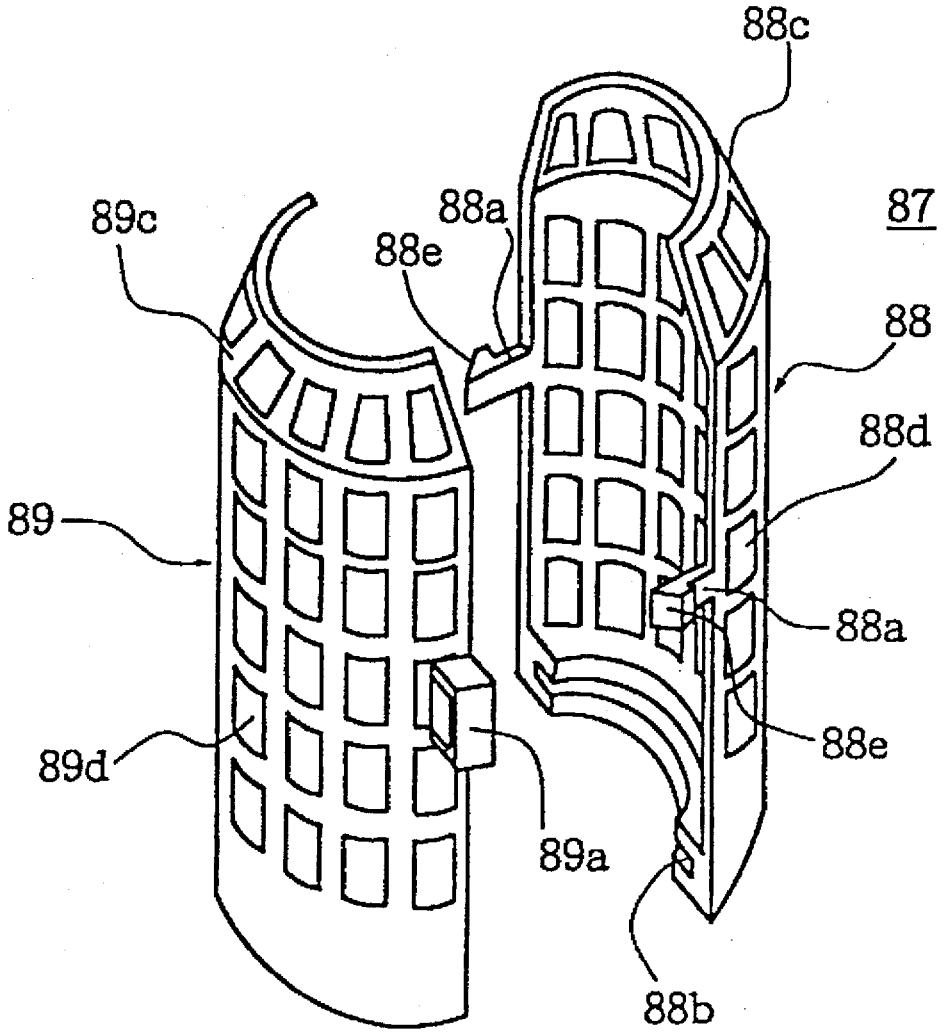
FIG. 7 is an exploded perspective view of a shield member in the solution tank.

The solution tank 70 in the automatic photographic developing apparatus of the embodiment will be described in more details referring to FIGS. 5 to 7. FIG. 5 is a cross sectional view of the solution tank 70 disposed in the processing tub 24. FIG. 6 is an enlarged cross sectional view of a level sensor 82. FIG. 7 is an exploded perspective view of a shield member 87.

The solution tank 70 is arranged for dissolution of the solid agent J and storage of its solution and communicated by a passage 72 to the corresponding solution bath in the processing tub 24. A flow of the solid agent solution is transferred through the passage 72. The solution tanks 70 and the processing tub 24 are protected with an openable cover 26. The cover 26 is opened when the maintenance of the solution tanks 70 and the processing tub 24 is carried out.

The solution tank 70 has a tubular filter 73 detachably mounted therein for filtering out impurities such as small paper strips from the processing solution. The filter 73 is communicated to the suction side of a circulation pump 75 by a circulating conduit 74 mounted across the bottom of the solution tank 70. The discharge side of the circulation pump 75 is coupled to another circulating conduit 76 which is communicated to a lower of the solution bath of the processing tub 24.

In action, a replenishment of the solid agent solution is transferred from the solution tank 70 to the solution bath of the processing tub 24 by the action of the circulation pump 75. The replenishment is then mixed with the solid agent solution in the solution bath of the processing tub 24 and returned back by the passage 72 to the solution tank 70 before repeating its circulating action. The circulation is not limited to that direction shown in FIG. 5 and may be conducted in the opposite direction. A guide extension 77 is provided above the filter 73 for directing the solid agent J supplied from the guide 71 to the center of the solution tank 70. As the guide extension 77 is joined indirectly to the guide 71 along which the solid agent J is supplied, the solid agent J runs above the filter 73 and falls into the center of the solution but does not drop from a high position. This allows less splashing off of the solution and prevents pieces of the solid agent J from striking the level sensor 82, a heater 81, or any other component in the solution tank 70. As the guide extension 77 is detachably mounted to the filter 73 in the solution tank 70 without use of any specific mounting jig, it can easily be removed when maintenance or cleaning of the solution tank 70 is desired.

More particularly, the guide 71 is mounted to a pivot pin 78 on the solution tank 70 for pivotal movement between a guiding position denoted by the real line in FIG. 5 and a non-guiding position denoted by the two-dot chain line where the cover 26 remains opened. When the guide 71 is in the non-guiding position denoted by the two-dot chain line, it is directly supported at its upper edge 71*a* by a stopper 79 fixedly mounted to an upper of position the processing tub 24 and simultaneously, holds the cover 26 open as shown in FIG. 5.

Accordingly, before starting the maintenance of any component, e.g. the filter 73, in the solution tank 70, the cover 26 is opened and the guide 71 is turned to its non-guiding position denoted by the two-dot chain line in FIG. 5. As the guide 71 has been moved from its guiding position, it will never disturb the dismounting and remounting of the filter 73 contributing to the ease of the maintenance. At the time, the guide extension 77 can be removed together with the filter 73 thus having no chance to retard the maintenance action.

After the maintenance or replacement of the filter 73 is completed, the guide 71 is returned back to the guiding position and secured. If the guide 71 remains in its non-guiding position, the cover 26 is also kept open and thus produces a warning. The apparatus is hence prevented from running without the guide 71 setting in the guiding position.

Although the guide 71 is pivotably mounted on the top of the solution tank 70 in the embodiment, it may be arranged on either the processing tub 24 or a main enclosure of the automatic developing apparatus B for pivotal movement. The guide 71 may be provided with a specific link mechanism for the pivotal movement rather than mounted on the pin 78.

The heater 81 in the solution tank 70 is provided of with a bar shape for heating the solid agent solution and accompanied with a thermal sensor 80 for monitoring the temperature of the solution. The heater 81 is partly immersed in the solution in the solution tank 70 and used for heating the solid agent solution circulated across the solution bath in the processing tub 24. Accordingly, the solid agent solutions in the processing tub 24 are kept at optimum temperatures for carrying out a series of the processes.

The level sensor 82 in the solution tank 70 is provided for monitoring the level of the solid agent solution. Upon the level sensor 82 detecting lowering of the level to a limit, a replenishment of the solid agent solution is supplied. More specifically, the level sensor 82 comprises a main body 83 and a reed switch 84 accommodated in the main body 83 as shown in FIG. 6. The main body 83 has a shaft portion 83*a* provided at a lower part thereof. A float 85 is fitted onto the shaft portion 83*a* for upward and downward movement. The float 85 moves vertically as the level of the solid agent solution is elevated up and down. The float 85 contains a magnet 86. When the magnet 86 in the float 85 lowers to its limit, its magnetic force causes the reed switch 84 to close for giving a warning signal.

The level sensor 82 is protected at the lowermost of its body 83 with the detachable shield member 87. The shield member 87 surrounding the float 85 comprises a pair of split guards 88 and 89 which are axially separable from each other and made of a resin material, as shown in FIG. 7. The guard 88 has two latches 88*a* provided at both sides thereof while the other guard 89 has two catch holes 89*a* arranged in both sides thereof. The guards 88 and 89 have two recesses 88*b* and 89*b* respectively provided in the lowermost parts thereof. The upper ends of the guards 88 and 89 are tilted inwardly forming cone portions 88*c* and 89*c* respectively. The guards 88 and 89 have a number of window openings 88*d* and 89*d* provided therein.

For assembly, the two guards 88 and 89 are coupled to each other with a bottom disk 83*b* of the level sensor body 83 accepted in and sandwiched between their recesses 88*b* and 89*b*. As the cone portions 88*c* and 89*c* hold the sensor body 83 from both sides, the two latches 88*a* are inserted into their respective catch holes 89*a*. In particular, as the latch 88*a* moves into the hole 89*a*, its tapered end 88*e* is pressed inwardly allowing the guard 88 to be joined to the guard 89 in a one-touch action.

The two guards 88 and 89 can easily be separated from each other by depressing and disengaging the taper ends 88*e* of the two latches 88*a* with fingers.

The two guards 88 and 89 of the shield member 87 are securely joined to each other with their recesses 88*b* and 89*b* holding the bottom disk 83*b* of the body 83 of the level sensor 82 and simultaneously, their cone portions 88*c* and 89*c* directly holding the level sensor body 83. In addition, the two latches 88*a* of the guard 88 are engaged with or disengaged from the corresponding catch holes 89*a* of the other guard 89 by a simple pressing action.

It is now understood that the level sensor 82 in the solution tank 70 is surrounded by and protected with the shield member 87 so that it is prevented from being hit by pieces of the solid agent J. This allows the level sensor 82 to be increased in the degree of freedom for installation. The shield member 87 protecting the level sensor 82 is comprised of the two separable guards 88 and 89 thus contributing to the ease of the maintenance of the level sensor 82.

Although the two guards 88 and 89 of the shield member 87 are joined to each other with the two latches 88*a* of the guard 88 being detachably engaged with the corresponding catch holes 89*a* of the guard 89 according to the embodiment, they may be coupled by pin linking means which is provided on one of the guards so that the other guard is pivotably moved about the pin linking means.

The shield member 87 protecting the level sensor 82 may fixedly be mounted to the level sensor 82.

Figure 8:
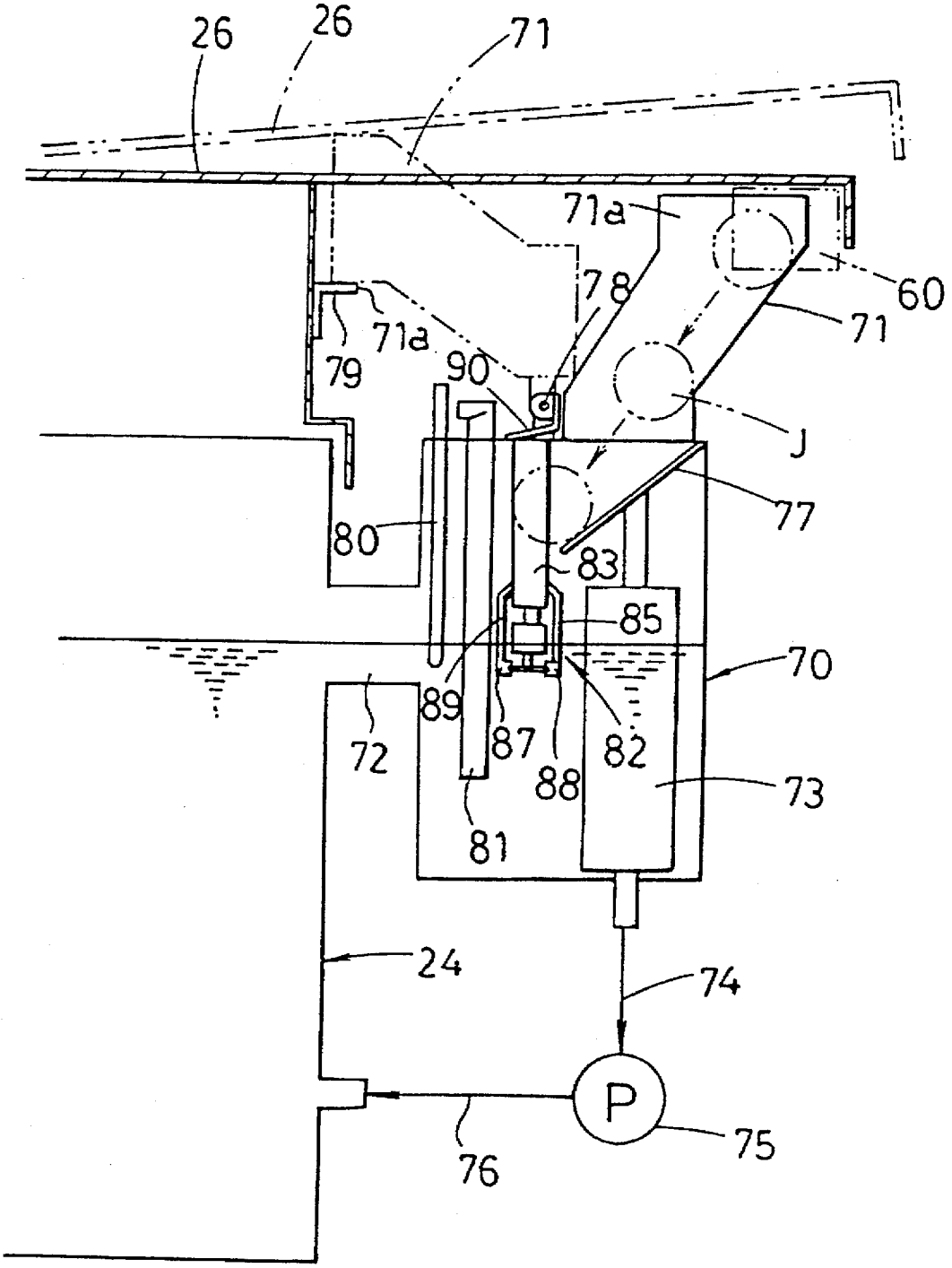
FIG. 8 is a cross sectional view showing a modification of a guide disposed in the solution tank.
Figure 9:
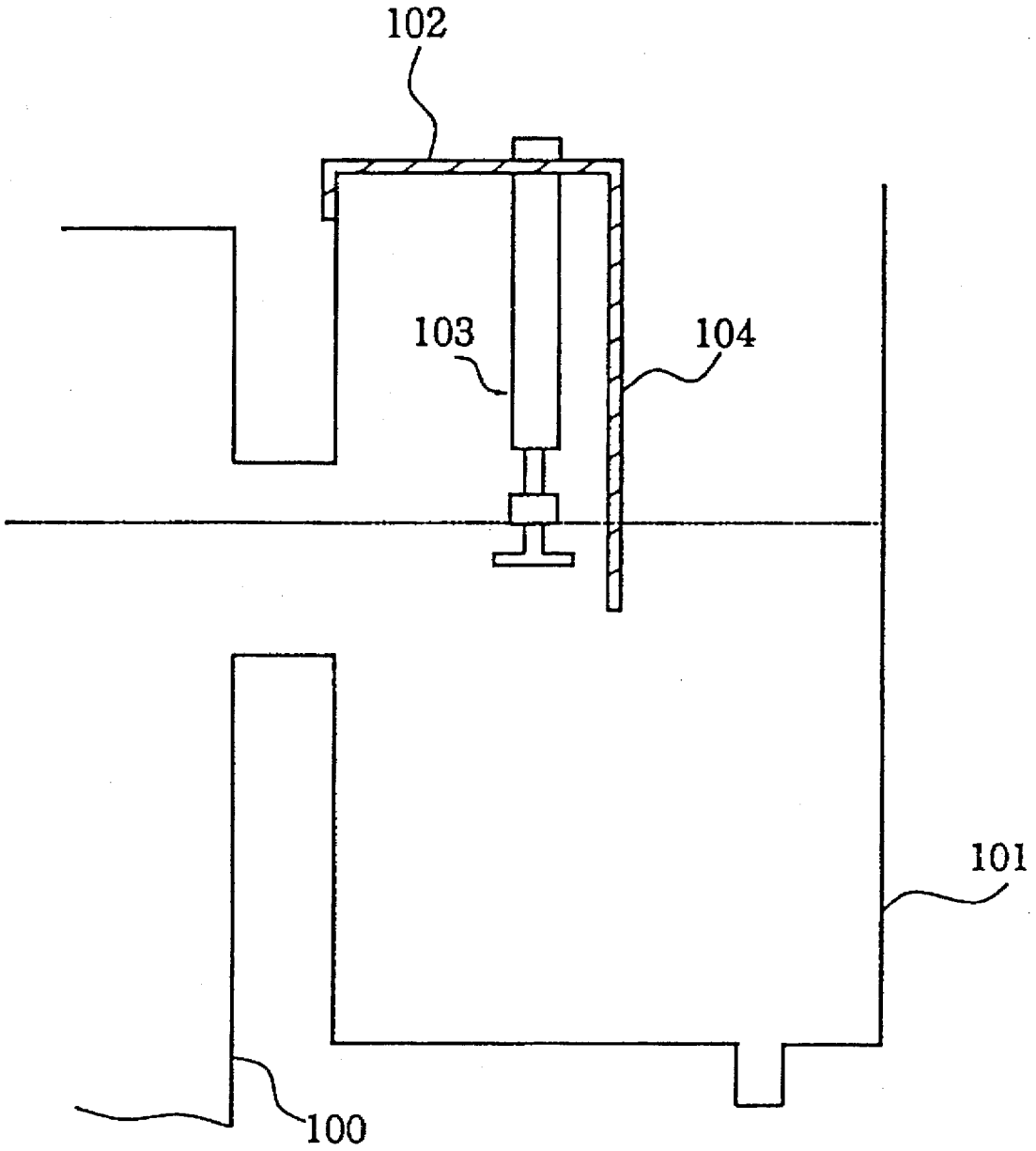
PRIOR ART Fig.9
FIG. 9 is a cross sectional view of a comparative solution tank disposed in a conventional processing tub.
Figure 10:
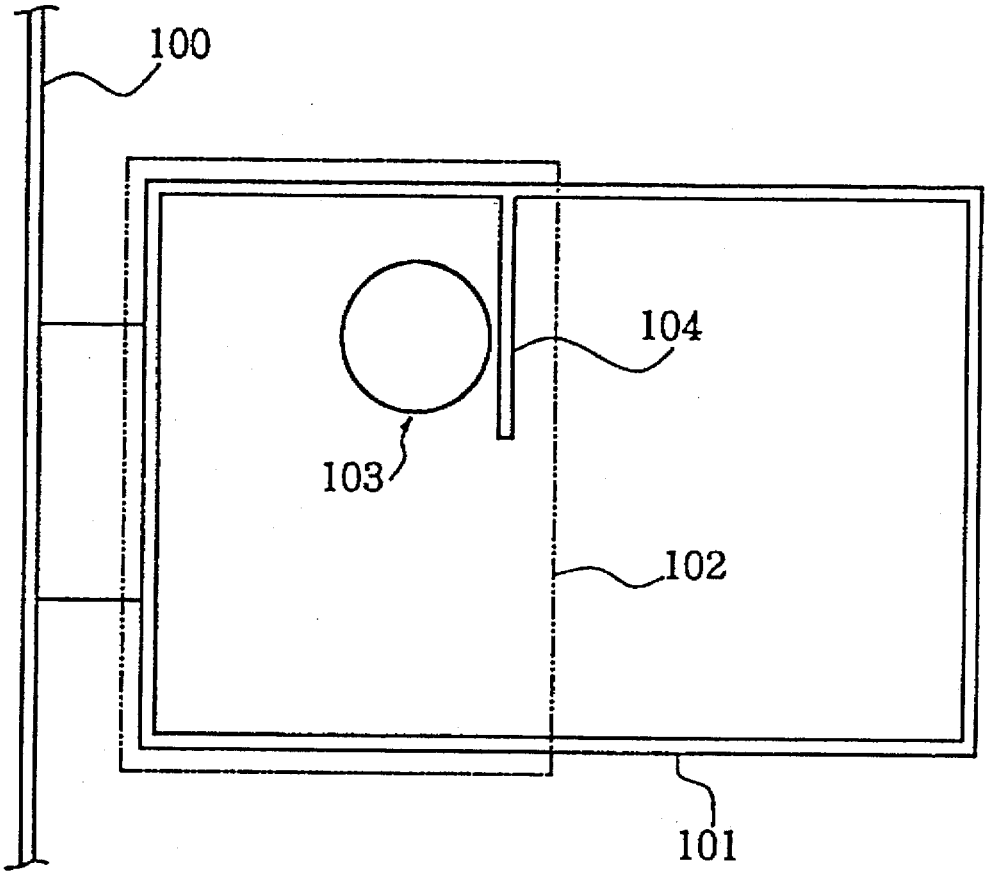
PRIOR ART Fig.10
FIG. 10 is a plan view of the comparative solution tank in the conventional processing tub.

FIG. 8 illustrates another embodiment as is similar to FIG. 5 where the guide 71 is modified so that it can automatically be returned to its original guiding position as soon as the maintenance of the solution tank 70 is completed with the guide 71 resting at the non-guiding position while the cover 26 being opened. The construction in FIG. 8 is similar to that of FIG. 5 except an automatic returning mechanism is provided for returning the guide 71 to its original guiding position. Hence, like components are denoted by like numerals shown in FIG. 5 and will be explained in no more detail.

The modified guide 71 is pivotably mounted to a pin 78 so that it can turn about the pin 78 to the non-guiding position over the solution tank 70 while the cover 26 being opened. In particular, an urging means or return leaf spring 90 is provided with its one end joined to the guide 71 and with the other end joined to the uppermost of the solution tank 70. The return leaf spring 90 remains urging the guide 71 to the guide location.

Accordingly, after the maintenance in the solution tank 70 is finished with the cover 26 opened, the guide 71 is automatically returned by the yielding force of the return leaf spring 90 from the non-guide location to the original guide location.

In order to carry out a maintenance action in the solution tank, the cover is opened and the guide is kept in its non-guiding position and away from the guiding position thus to ease the maintenance action in the solution tank. After the maintenance action is completed, the guide is returned to the original guiding position. If the guide fails to be returned back to the guiding position and stays in the non-guiding position, it allows the cover not to be closed resulting in generation of a warning signal. Accordingly, the apparatus will be prevented from running with the guide placed in the non-guiding position.

The level sensor in the solution tank is protected with the shield member so that no piece of the solid agent is allowed to strike against the level sensor. Accordingly, the positioning of the level sensor in the solution tank will have a higher degree of freedom.

The shield member may be detachably mounted to the level sensor which can thus be handled with much ease during the maintenance action.

The guide extension may be mounted on the filter for directing the solid agent into the processing solution in the solution tank thus allowing no straight drop of the solid agent into the solution. Accordingly, unwanted splashing of the processing solution will be prevented and undesired physical contact of the solid agent with the level sensor, the heater, or other components in the solution tank will be avoided. As the guide extension is directly mounted on the filter, it requires no specific mounting jigs for installation.

The guide extension and filter are detachable and will easily be removed from the solution tank for ease of the maintenance.

For starting a maintenance action in solution tank the cover is opened and the guide is turned to its non-guiding position. As the guide being held down by the cover, it is kept away from the guiding position and thus allows the solution tank to be clearly accessed for ease of the maintenance. After the maintenance is completed, the guide is released and automatically returned from the non-guiding position to the original guiding position by the urging action of the return leaf spring. Accordingly, the apparatus will be prevented from running with the guide being set in its non-guiding position.

What is claimed is:

1. An automatic photographic developing apparatus for photosensitive materials comprising:

a number of processing baths which are filled with processing solutions of different types for processing silver halide coated photosensitive materials;

a same number of solution tanks communicated with respective processing baths for supplying the processing solutions, which processing solutions are produced by dissolving solid agents in said solution tanks, to the respective processing baths;

a level sensor installed in each of the solution tanks which monitors the level of the processing solution in the respective solution tanks; and a plurality of shield members, each shield member surrounding and protecting a respective one of said level sensors from said solid agents in said solution tanks, and each shield member being detachably mounted to its respective installed level sensor, wherein each of the shield members comprises a plurality of split members which are separable from each other and which are connectable to each other to surround the respective level sensor.

2. An automatic photographic developing apparatus according to claim 1, wherein said split members are perforated to permit liquid to flow therethrough.

3. An automatic photographic developing apparatus according to claim 1, wherein said split members are two in number and are axially separable from each other, and wherein said split members comprise closure members which engage each other for closing said split members to surround the respective level sensor.

4. An automatic photographic developing apparatus according to claim 3, wherein said split members are perforated to permit liquid to flow therethrough.

5. An automatic photographic developing apparatus for photosensitive materials comprising:

a number of processing baths which are filled with processing solutions of different types for processing silver halide coated photosensitive materials;

a same number of solution tanks communicated with respective processing baths for supplying the processing solutions, which processing solutions are produced by dissolving solid agents in said solution tanks, to the respective processing baths;

a level sensor installed in each of the solution tanks which monitors the level of the processing solution in the respective solution tanks, the level sensor comprising a main body, a reed switch accommodated in the main body, a shaft portion provided in a lower section of the main body, a float fitted onto the shaft portion for upward and downward movement, and a magnet accommodated in the float; and a plurality of shield members, each shield member surrounding and protecting a respective one of said level sensors from said solid agents in said solution tanks, and each shield member being detachably mounted to its respective installed level sensor.

* * * * *